US005586717A

United States Patent [19]

Hallam

[11] Patent Number: 5,586,717

[45] Date of Patent: Dec. 24, 1996

[54] CARTON AND CARTON HINGE CONSTRUCTION

[75] Inventor: Christopher P. Hallam, Bradford, United Kingdom

[73] Assignee: Concept Packaging Limited, Bradford, United Kingdom

[21] Appl. No.: 385,954

[22] Filed: Feb. 9, 1995

[30] Foreign Application Priority Data

Feb. 9, 1994 [GB] United Kingdom ..... 9402512

[51] Int. Cl.[6] ..... B65D 5/56; B65D 5/64

[52] U.S. Cl. ..... 229/116.1; 206/457; 229/23 R; 229/163; 229/909

[58] Field of Search ..... 229/23 A, 23 R, 229/116.1, 163, 909; 206/457

[56] References Cited

U.S. PATENT DOCUMENTS

| | | | |
|---|---|---|---|
| 2,061,992 | 11/1936 | Wilson | 229/116.1 |
| 2,773,633 | 12/1956 | Haslett | 229/116.1 |
| 3,469,765 | 9/1969 | Mueller | 229/909 |
| 3,478,949 | 11/1969 | Richgels | 229/163 |
| 4,380,314 | 4/1983 | Langston, Jr. et al. | 229/909 |
| 4,467,920 | 8/1984 | Smith | 206/457 |
| 4,503,974 | 3/1985 | Lane | 206/457 |
| 5,183,200 | 2/1993 | Okamoto | 229/23 R |

FOREIGN PATENT DOCUMENTS

| | | | |
|---|---|---|---|
| 418254 | 10/1934 | United Kingdom | 229/23 R |
| 547523 | 9/1942 | United Kingdom . | |
| 642814 | 9/1950 | United Kingdom . | |

*Primary Examiner*—Gary E. Elkins
*Attorney, Agent, or Firm*—Spencer & Frank

[57] ABSTRACT

A carton. The carton includes a rigid body having an open top and a slot formed therein, and a cover member for covering the open top. The cover member includes an outer cover panel hingedly connected to the body at a hinged connection and having an underside; and an inner cover panel folded upon the underside of the outer cover panel to be in face-to-face relation with the underside of the outer cover panel such that an outer edge of the inner cover panel registers with the hinged connection. The inner cover panel further includes, at the outer edge thereof, a locating flap having a tongue slidably received in the slot formed in the body.

8 Claims, 3 Drawing Sheets

CARTON AND CARTON HINGE CONSTRUCTION

BACKGROUND OF THE INVENTION

This invention relates to cartons of the kind comprising an open-topped body with a cover hingedly connected thereto for the closure of the open top. The invention has been developed primarily for so-called "book pack" type cartons, that is to say cartons which are intended in their external appearance to resemble a book, the body including a base which extends outwardly beyond the walls of a rectangular body on three sides thereof, and a cover of similar size, so that the base and cover resemble book covers, the carton also including, at the remaining side of the body from which the base and cover do not project, a panel to resemble the spine of a book cover.

However, as will hereinafter become apparent, the invention is not limited in its applicability to such "book pack" type cartons.

Conventionally, "book pack" type cartons comprise a rigid rectangular inner component which forms the body proper, and an outer component which comprises the panels which form the base, cover and spine. Traditionally, the outer component is formed in the same way as a genuine hard back book cover, and comprises three panels of board each having a substantial thickness, e.g. around 1000 microns, which are hingedly connected together.

There are currently three methods of producing such a three panel outer book cover. Firstly a one-piece member of board about 1000 microns thick can be divided into the three panels by cutting away much of the thickness of the board, e.g. by routing, along the required fold lines. Secondly, instead of removing material in this way, such board can be creased along the fold lines. Thirdly, the three panels may be formed separately and jointed by a means of a layer of a facing material.

To achieve the required flexibility at the hinge, the thickness of the material which forms the hinge needs to be kept to a minimum yet have adequate strength. However, in a book pack type carton there is the additional requirement of attaching the outer component to the body, for which a secondary hinge piece is normally utilised. This increases resistance to bending at the hinge line.

The step of assembling the three boards requires considerable skill and as a result the product is expensive to manufacture. Even where the three panels are formed from a single member the step of locating the outer component accurately in relation to the inner member whilst they are secured together requires skill and accuracy such that a jig is normally required.

Substantial savings in time, cost and skill could be achieved if, instead of employing three separate boards, a one-piece blank could be used. However, the required strength for the base and cover panels has generally necessitated the use of relatively thick board, which cannot satisfactorily be folded so as to enable it to be made from a one-piece blank, and which in particular presents problems with regard to the construction of the hinge between the spine and cover panels because of the thickness and stiffness of the board material conventionally employed. If a sufficiently flexible hinge is to be achieved, the thickness of the board material along the intended hinge line must be very substantially reduced, leading to serious weakness at the hinge.

SUMMARY OF THE INVENTION

In accordance with one aspect of the invention, we provide a carton of a "book pack" type which comprises a rigid rectangular inner component having four side walls and a bottom defining an open-topped body for the reception of one or more articles therein and an outer component. The outer component comprises a base panel extending beyond three of the side walls of the body at the bottom, an intermediate panel which extends across the fourth side wall of the body from the bottom to the open top, and a cover member which is hingedly connected to the intermediate panel and which extends beyond the three side walls of the body and serves to cover the open top of the body. The outer component comprises a one-piece blank which includes four contiguous generally rectangular panels separated by fold lines and defining respectively the base panel, the intermediate panel, an outer cover panel and an inner cover panel which is folded inwardly in face-to-face relation with the underside of the outer cover panel to form the cover member, the inner cover panel in turn carrying, at an edge thereof which registers with the fold line between the outer cover panel and the intermediate panel, a locating flap which includes a tongue slidably received in a slot formed in the fourth side wall of the inner component.

To assemble the inner and outer components, after the inner and outer cover panels have been secured together in face-to-face relationship, the tongue of the locating flap is simply inserted into the slot. The length of the slot may correspond to the width of the tongue so as to locate the cover member accurately over the open top of the body, and in this case the tongue is preferably formed with tapering side edges so that the outer component is centred relative to the body as the tongue is inserted into the slot.

In an alternative and preferred arrangement, however, the locating flap further includes locating tabs adapted to co-operate with those side walls of the body that are disposed adjacent to the fourth side wall.

The intermediate and base panels may then be folded around the body to bring the base panel into face-to-face engagement with the base of the body to which it is adhesively or otherwise secured whilst the cover member remains located on the open top of the body.

However, since the locating flap is not secured either to the fourth side wall of the body or to the intermediate panel of the outer component and the tongue is free to slide within the slot, the locating flap as a whole is allowed to move relative to the intermediate panel and the fourth side wall of the body as the cover member is opened and closed relative to the open top of the body. This avoids the difficulties which would arise if the inner and outer panels of the cover were hingedly secured along fixed lines which cannot be coincident, whilst at the same time providing a hinge/joint of greater strength than in conventional book pack type cartons or indeed many conventional hard back book covers.

Whilst the slot may be formed as a slit without removing material from the intermediate panel, this may cause significant resistance to movement of the tongue and accordingly it is preferred to form the slot by removing material from the panel.

Since the cover member is formed as two thicknesses of board material, the blank as a whole can be made from material of a thinner gauge than would normally be used, making it easier to achieve the required degree of flexibility at the fold line between the intermediate panel and the cover panel.

If required, a double-thickness base member, similar to the double-thickness cover member, may be formed by providing an inner base panel folded inwardly over an outer base panel in the same manner as the inner and outer cover panels, but this may not always be considered necessary, particularly if the inner component includes a base member which extends between the side walls of the body.

Whilst the construction described above is in terms of a "book pack" type carton, other types of carton may be constructed in generally the same manner and, in particular, using the same type of hinge construction.

Thus, it is not necessary for the base and cover members to extend beyond any edge of the body, and the body need not be of simple rectangular shape.

In fact, the inner component may comprise a rigid body of any appropriate shape in outline, with correspondingly, or differently, shaped base and cover members which may or may not extend beyond one or more side walls of the body. Moreover, the side walls need not be of planar form, but could include one or more curved wall panels, or indeed be of generally round or oval form in plan, but with one planar wall at which the cover member is hinged. Two or more separate cover members could be provided, hingedly connected in a similar manner to one or more side walls.

Further, the open top of the body need not be of planar form. For example, in the case of a rectangular body, the two side walls adjacent to the side wall at which the cover member is hinged could each have a convexly curved upper edge to form a carton of the "treasure chest" type in which the cover panel is of correspondingly concavely curved form.

Thus, in accordance with a more general aspect of the invention, we provide a carton of a type which comprises an inner component including a rigid body having an open top bounded by side walls which define bottom edges and which include at least one side wall of planar form the carton further includes an outer component which comprises a base panel assembled with the body at the bottom edges of the side walls thereof, an intermediate panel which extends across said one planar side wall from the bottom edge thereof to the open top of the body and a cover member hingedly connected to the intermediate panel which serves to cover the open top of the body. The outer component comprises a one-piece blank including four contiguous panels separated by fold lines and defining, respectively, the base panel, the intermediate panel, an outer cover panel and an inner cover panel folded inwardly in face-to-face relation with the underside of the outer cover panel to form the cover member, the inner cover panel in turn carrying, at an edge thereof which registers with the fold line between the outer cover panel and the intermediate panel, a locating flap including a tongue slidably received in a slot formed in the one planar side wall of the rigid body.

The base panel may be of a similar size and shape to the bottom of the body so as to extend across all of the area bounded by the side walls of the body.

More generally, the invention resides in a carton of a type which comprises a rigid body having an open top and a cover member which is hingedly connected to the body for movement into and out of a position of closure relative to the open top, wherein the cover member comprises an outer cover panel having an hinged connection to the body, an inner cover panel arranged in face-to-face relation with the outer cover panel. Integrally and foldably connected to the inner cover panel, at an edge thereof which is in register with the hinged connection, there is provided a locating flap which includes a tongue slidably received in the slot formed in the rigid body.

BRIEF DESCRIPTION OF THE DRAWINGS

The invention will now be illustrated by way of example with reference to the accompanying drawings wherein.

DESCRIPTION OF THE PREFERRED EMBODIMENTS

Figure 1:
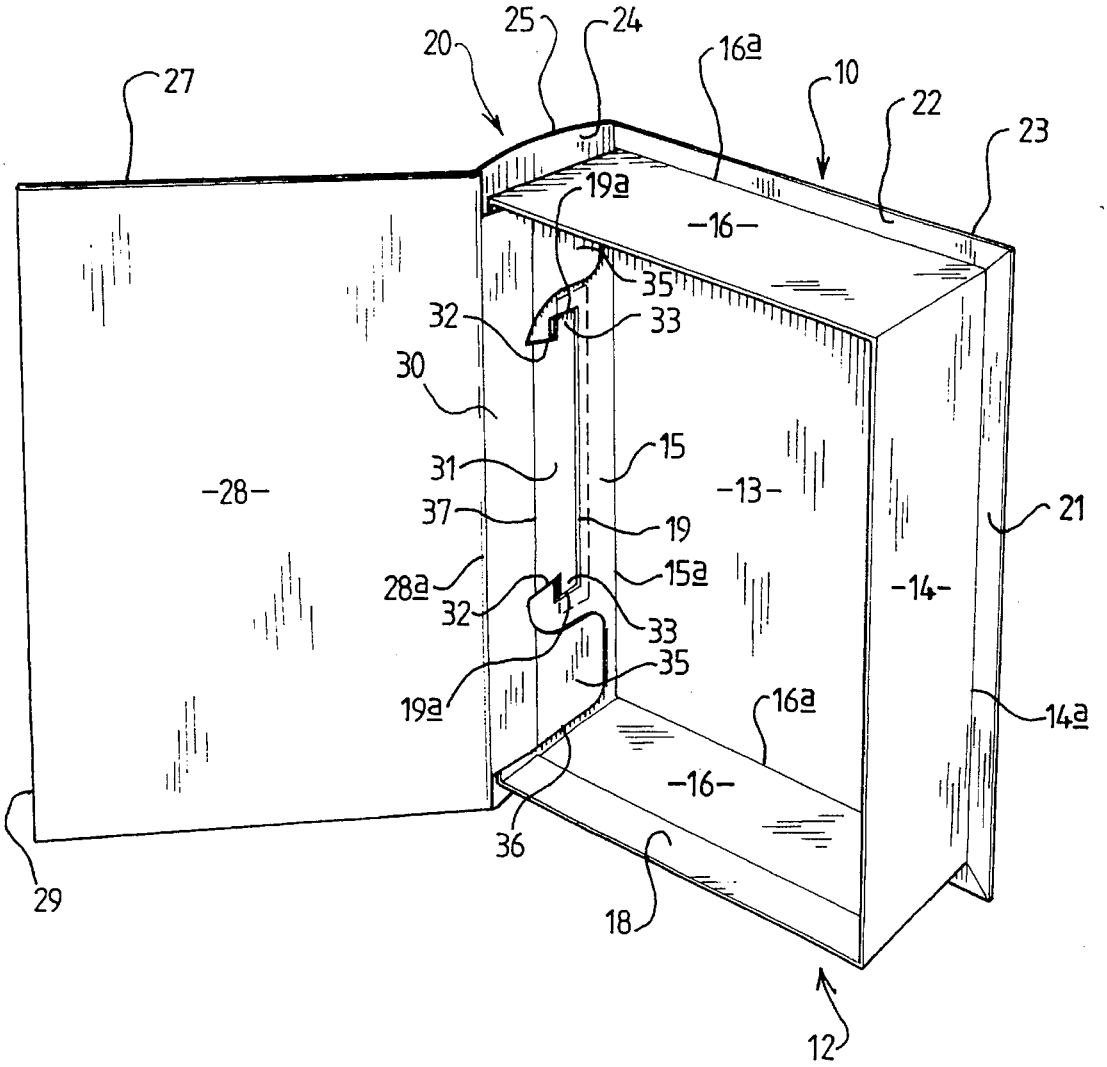
FIG. 1 shows a perspective view of one embodiment of "book pack" type carton, shown in an upright position with the cover open to reveal details of the hinge construction.

The "book pack" type carton 10 illustrated in FIG. 1 comprises an inner component in the form of a rigid body 12 and an outer or cover component 20.

The body 12 is of conventional construction and comprises a rectangular base 13 having integrally and foldably connected thereto front and rear wall panels 14 and 15 at opposite edges 14*a* and 15*a* respectively and a pair of side wall panels 16 integrally and foldably connected at opposed edges 16*a*. The wall panels are secured together at the corners of the body, for example by means of adhesive tape 17 (shown in FIG. 3) to form a rigid construction, and at least the outer faces of the walls may be covered with a layer of facing material 18, for example paper marked to represent the edges of the pages of a book. An elongated rectangular slot 19 is formed in rear wall panel 15 for the purpose hereinafter described.

The cover component 20 comprises a base panel 23 which is secured to the base 13 of the body 12 in such a manner as to form a flange projecting outwardly from the front edge 14*a* and side edges 16*a* thereof, an intermediate panel 25 which is disposed adjacent to the rear wall panel 15 of the body 12 and in use may be slightly convexly curved so as to have the appearance of a book spine, and a cover member 29 formed from outer and inner panels 27 and 28 each of the same dimensions as the base panel 23.

Figure 2:
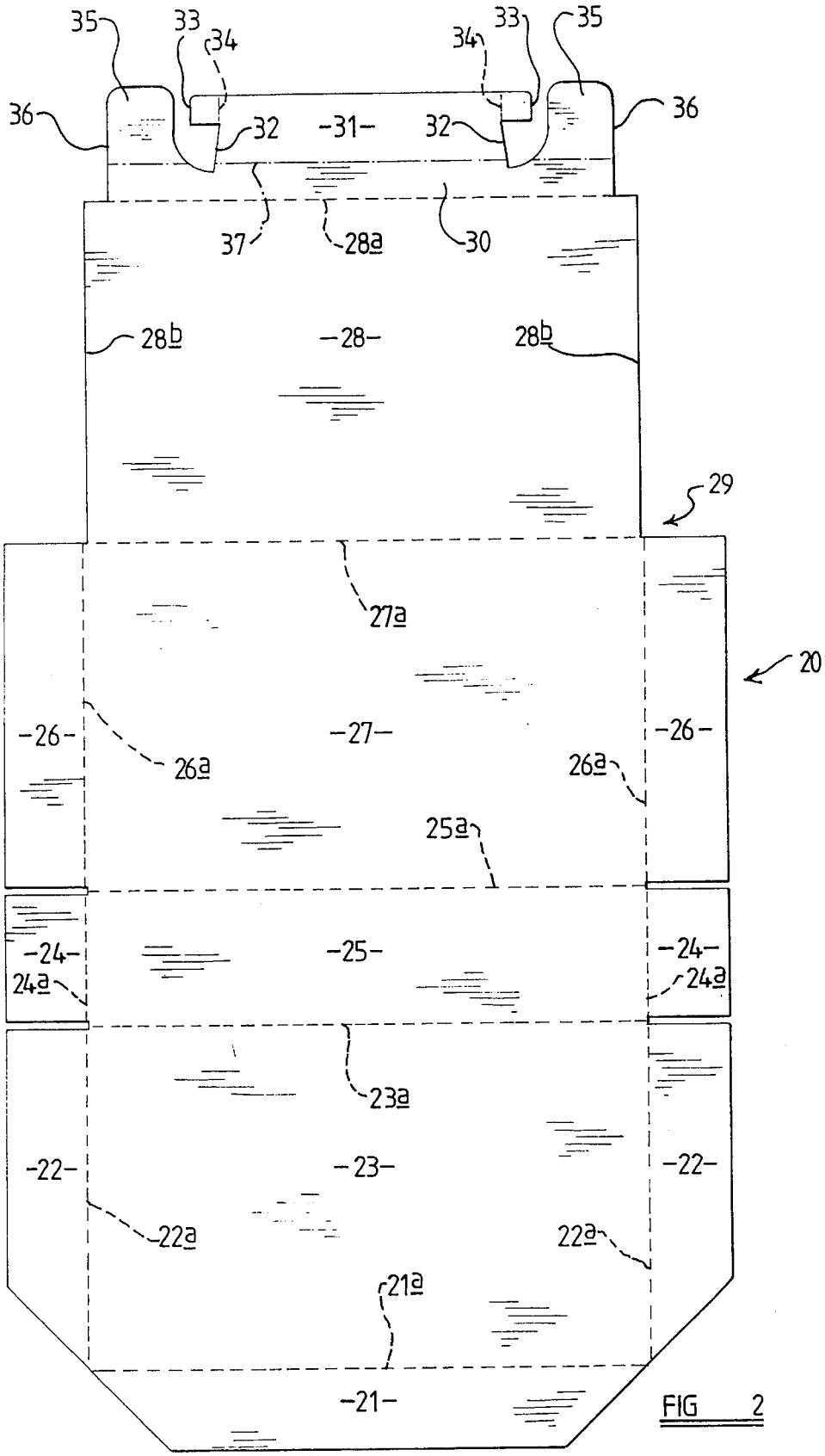
FIG. 2 is a plan view of a one-piece blank which is used to form an outer component of the carton shown in FIG. 1.

Referring now to FIG. 2, the cover component 20 is formed from a one-piece blank as illustrated therein. As can be seen, the base panel 23 is integrally and foldably connected with the intermediate panel 25 along fold line 23*a*, and the intermediate panel is itself integrally and foldably connected with the outer cover panel 27 along fold line 25*a*.

In the illustrated embodiment, the base panel 23 carries flaps 21 and 22 integrally and foldably connected along edges 21*a* and 22*a* thereof, the intermediate panel 25 carries flaps 24 integrally and foldably connected at the end edges 24*a* thereof, and the outer panel 27 carries flaps 26 integrally and foldably connected therewith along side edges 26*a* thereof. The flaps 21, 22 and 26 are folded inwardly so as to overlie the adjacent panels and adhesively secured in position so that the exposed edges of the panels 23 and 27 are smoothly rounded on the fold lines 21*a*, 22*a*, and 26*a* instead of presenting raw edges as would be the case in the absence of these flaps. Additionally, the flaps 24 are turned inwardly for the same reason and may or may not be secured adhesively. However, it will be appreciated that the flaps 21,22,24 and 26 may be omitted if required, and the panels 23,25 and 27 could then be covered with any suitable facing material which extends over the otherwise exposed edges of the panels. Indeed, even when the flaps 21,22,24 and 26 are provided the cover component 20 may preferably be covered externally with an appropriate facing material marked to simulate the appearance of a book cover, or be hand-covered in the same manner as a traditional book cover.

The blank is completed by the inner cover panel 28 which is integrally and foldably connected with the outer cover panel 27 along edge 27*a* thereof, the inner cover panel 28 in turn carrying, at its edge 28*a* opposite the edge 27*a* at which it is connected to cover panel 27, a flap 30 foldably and integrally connected thereto.

The flap 30 is shaped to define a central tongue 31 having inclined side edges 32 and lateral extensions 33 at the edges of the tongue 31 furthest from the fold line 28*a*, and further shaped to define lateral tabs 35 having straight side edges 36 which are inwardly offset relative to the corresponding side edges 28*b* of the panel 28.

In use, the inner cover panel 28 is folded inwardly about fold line 27*a* over the adjacent outer cover panel 27 so as to bring the fold line 28*a* into proximity with the fold line 25*a* whereby the cover panel 27 is foldably connected to the intermediate panel 25. The panels 27 and 28 may be secured together for example by gluing to form a double thickness cover member 29. The flaps 26 can be secured directly to the inner face of the cover panel 27 before the panel 28 is folded inwardly and secured to form the cover member 29. Alternatively, if required the flaps 26 can be secured to the inner cover panel 28.

The outer cover panel 27 may then be formed with an opening or "window" and left unsecured at the inner cover panel 28 adjacent to one or more edges of the panel 27 to form a sleeve in which a card or the like may be inserted for display by means of said "window".

To assemble the cover component 20 with the body 12, the tongue 31 of the flap 30 is inserted into the slot 19 formed in the rear wall panel 15 of the body 12. The length of the slot 19 between the opposed ends 19*a* thereof is somewhat less than the spacing between the opposed end edges of the lateral extensions 33 of the tongue 31, but the flexibility of the material is such that, with the addition of creases 34 if required, the extensions 33 can be inserted through the slot 19 to engage behind the wall panel 15 at the opposite ends of the slot, thereby allowing the tongue 31 to be inserted through the slot from the inwardly directed face of the wall panel 15 into the space between the wall panel 15 and the intermediate panel 25 of the cover component 20. The extensions 33 then prevent the tongue 31 being withdrawn from the slot 19. The side edges 36 of the tabs 35 engage against the side wall panels 16 to ensure that the cover component 20 is centralised relative to the body 12, without the need for any jig. The side edges 36 of the tabs 35 may be somewhat inclined to act as locators when the cover member is closed onto the body.

The side edges 32 of the tongue 31 may additionally assist in the location of the cover component 20 by engagement with the end edges of the slot 19, or as hereinafter described the tabs 35 may be omitted so that the cover member 20 is located solely by means of the tongue 31.

Figure 3:
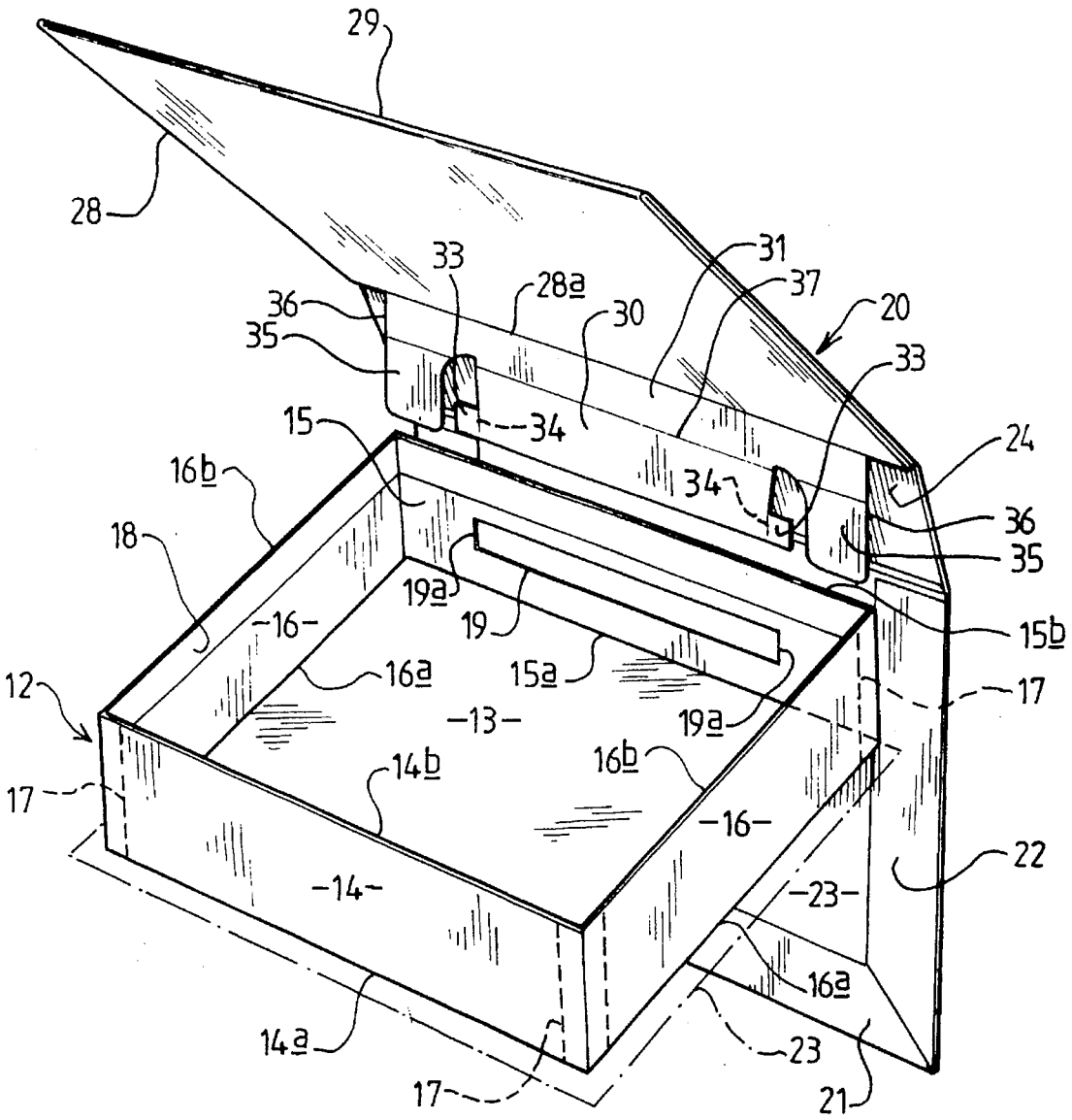
FIG. 3 is a perspective view showing an inner component of the carton of FIG. 1 and the outer component formed from the blank of FIG. 2, preparatory to assembly of the two components to form the complete carton.

After the flap 30 has been assembled with the rear wall panel 15, the base panel 23 of the cover component 20 can then be folded rearwardly beneath the base 13 of the body 12 and adhesively secured thereto in the position indicated in the chain dot lines in FIG. 3, whilst the cover member 29 comprising the panels 27 and 28 in combination is held against the open top of the body 12 to produce the "book pack" type carton 10 as illustrated in FIG. 1. In this process the fold line 25*a* comes into general register with the edge 15*b* and the cover member 29 can engage the upper edges 14*b*, 16*b* of the front and side walls 14 and 16 of the body 12 and thereby close the open mouth defined by the upper edges of the wall panels.

Because the tongue 31 is only located in the slot 19 and not fixed to the rear wall panel 15 of the body, the cover member can be fully opened and closed without imposing a strain on the cover components, particularly at the hinge connection, whereas if flap 30 were to be fixed, the fact that the centres of folding defined by fold lines 25*a*, 28*a* cannot be coincident and move relative to one another would tend to disrupt the cover member at any point of weakness due to the leverage arising from the fact that panel 28 and flap 30 collectively move at a different rate from panels 27 and 25 as the cover member is opened.

The above applies throughout the whole range of movement of the cover member 29 from its position of closure to a fully open position which may extend over more than 180°. However, additionally, as the cover member is opened by more than 90°, the junction between the panel 28 and flap 30 will tend to be stretched over the upper edge of the rear wall 15 of the body 12 and over the corresponding edge of the intermediate panel 25. If the flap 30 were to be secured immovably to the rear wall 15, the resulting strain in the material would cause it to tear in the vicinity of the fold. By allowing the flap 30 to slide relative to the rear wall 15, this difficulty is overcome. To further facilitate the opening of the cover member 29, a crease 37 may be formed to extend across the tongue 31 and preferably also across tabs 35. Such crease is so positioned as to align with the upper edge of the rear wall 15 as the cover member approaches its 180° position thereby promoting a uniform and natural folding of the material about the hinge line.

Because the cover member 29 is formed from two layers of board material, the blank from which the cover component 20 is formed can be substantially reduced in thickness as compared with the board material conventionally used for the construction of book covers or the cover members of conventional "book pack" type cartons. As a result, the connection between the intermediate panel 25 and the cover panel 27 can satisfactorily be formed by means of a crease without interrupting the structural integrity of the board, as would otherwise be necessary, by the formation of a score line, with the thicker material conventionally used. In this way, the strength of the connection between these two panels can be at least as great as that afforded by a conventional construction in which two separate panels are joined together by means of flexible tape.

If desired, the base panel 23 of the cover component 20 could carry, at the edge 21*a* thereof, instead of the flap 21, a further panel of the same size as panel 23 itself to be folded inwardly into overlying relation with the panel 23, in a similar manner so that in which the panel 28 is folded over the panel 27 so as to form a composite bottom member of the cover component 20 of the same thickness as the cover member 29.

Whilst the body 12 as illustrated and described above forms a simple rectangular box-like construction with base 13 and planar walls 14, 15, 16, it will be understood that a similar type of cover component could be employed with other types of bodies.

For example, in some cases a rectangular body could be formed by means of a four rectangular wall panels which are integrally and foldably connected to one another rather than to a base, such wall panels then having flaps integrally and foldably connected thereto at the edges equivalent to the edges 14*a*, 15*a*, 16*a* of the previously described embodiment, the base panel 23 of the cover component 20 then being adhesively secured to such flaps and serving as the base of the body.

Further, the body need not be of simple rectangular shape, but could be formed to any other appropriate shape, including triangular, trapezoidal, pentagonal, hexagonal etc. with planar wall panels, or to similar shapes with at least some convexly or concavely curved wall panels, provided that there is at least one planar wall panel to serve to afford the slot which receives the tongue of the cover component 20 to enable such component to be assembled with the body. It will be appreciated that in such cases the base and cover panels of the cover component may be shaped in accordance with the body and so dimensioned as to afford a flange which projects outwardly from the body over the walls thereof other than that at which the cover component is connected, or so dimensioned as to correspond closely with the top and bottom of the body and not to project therefrom.

In a further alternative arrangement the base panel and/or the cover panel of the cover component could be shaped differently from the body.

Whilst in the above-described embodiment, the cover member is formed from two integrally and foldably connected panels, it would alternatively be possible for the inner cover panel to be formed separately from the outer cover panel and secured thereto in any suitable manner, e.g. adhesively. Thus, the locating flap could be carried by a relatively narrow panel secured to the underside of a single-thickness cover panel adjacent to the edge at which the cover panel is foldably connected to the intermediate or mounting panel.

In all cases, in accordance with the invention, the cover member (29) comprises outer and inner panels (27,28), the outer panel (27) being hingedly connected to an adjacent panel (25) whereby the outer component (20) as a whole is assembled with the body (12) and the inner panel (28) being hingedly connected to a flap (30) which is formed to provide a locating tongue (31) which is slidably received in a correspondingly dimensioned slot (19) formed in a wall (15) of the body (12), or of an internal fitting within the body.

I claim:

1. A "book pack" type carton comprising:

a rigid rectangular inner component having four side walls and a bottom connected to the four side walls, the inner component defining an open top for receiving at least one article therein, one of the four side walls being a rear wall having a slot formed on an inner side thereof; and an outer component assembled with the inner component, the outer component being a one-piece member including:

a generally rectangular base panel connected to the bottom of the inner component and extending beyond three of the four side walls of the inner component which do not include the rear wall;

a generally rectangular intermediate panel contiguous with the base panel and separated therefrom by a first fold line, the intermediate panel extending across the rear wall in a direction from the bottom of the inner component toward the open top of the inner component; and a cover member for covering the open top of the inner component, the cover member extending beyond the three of the four side walls of the inner component when it covers the open top of the inner component and including:

a generally rectangular outer cover panel contiguous with the intermediate panel and separated therefrom by a second fold line so as to be hingedly connected to the intermediate panel, the cover member being adapted to pivot about the second fold line for covering the open top of the inner component and having an underside;

a generally rectangular inner cover panel contiguous with the outer cover panel and separated therefrom by a third fold line, the inner cover panel being folded upon the underside of the outer cover panel along the third fold line to be in face-to-face relation with the underside of the outer cover panel such that an outer edge of the inner cover panel registers with the second fold line, the inner cover panel further including, at the outer edge thereof, a locating flap having a tongue slidably received in the slot formed on the inner side of the rear wall for assembling the outer component with the inner component.

2. The carton according to claim 1, wherein a width of the tongue corresponds to a length of the slot, the cover member thereby being accurately locatable relative to the open top of the inner component.

3. The carton according to claim 2, wherein the tongue includes tapering side edges for centering the outer relative to the inner component when the tongue is slidably received in the slot.

4. The carton according to claim 1, wherein the locating flap further includes locating tabs thereon adapted to cooperate with side walls of the inner component disposed adjacent the rear wall.

5. The carton according to claim 1, wherein the base panel is a double-thickness one-piece base member including an outer base panel having an underside and an inner base panel contiguous with the outer base panel and separated therefrom by a fourth fold line, the inner base panel being folded upon the underside of the outer base panel along the fourth fold line to be in face-to-face relation with the underside of the outer base panel.

6. A carton comprising:

a rigid body having side walls including at least one planar wall having a slot formed on an inner side thereof, the side walls further having bottom edges, the body defining an open top for receiving at least one article therein; and an outer component assembled with the body, the outer component comprising a one-piece member including:

a base panel connected to the bottom edges of the side walls;

an intermediate panel contiguous with the base panel and separated therefrom by a first fold line, the intermediate panel extending across the planar wall in a direction from the bottom edges of the side walls toward the open top of the body; and a cover member for covering the open top of the body including:

an outer cover panel contiguous with the intermediate panel and separated therefrom by a second fold line so as to be hingedly connected to the intermediate panel, the cover member being adapted to pivot about the second fold line for covering the open top of the body and having an underside; and an inner cover panel contiguous with the outer cover panel and separated therefrom by a third fold line, the inner cover panel being folded upon the underside of the outer cover panel along the third fold line to be in face-to-face relation with the underside of the outer cover panel such that an outer edge of the inner cover panel registers with the second fold line, the inner cover panel further including, at the outer edge thereof, a locating flap having a tongue slidably received in the slot formed on the inner side of the planar wall for assembling the outer component with the body.

7. The carton according to claim 6, wherein the bottom edges of the side walls enclose an area, and wherein the base panel is of a similar size and shape as the area thereby extending across all of the area for serving as a bottom for the body.

8. A carton comprising:

a rigid body having an open top and a slot formed therein; and a cover member for covering the open top including:

an outer cover panel hingedly connected to the body at a hinged connection and having an underside; and an inner cover panel folded upon the underside of the outer cover panel to be in face-to-face relation with the underside of the outer cover panel such that an outer edge of the inner cover panel registers with the hinged connection, the inner cover panel further including, at the outer edge thereof, a locating flap having a tongue slidably received in the slot formed in the body.

* * * * *